United States Patent [19]

Hawk

[11] 3,947,135

[45] Mar. 30, 1976

[54] PAINT TRAY

[75] Inventor: Gary D. Hawk, Iola, Kans.

[73] Assignee: Harding Development Co., Clearwater, Fla.

[22] Filed: Feb. 13, 1975

[21] Appl. No.: 549,639

Related U.S. Application Data

[63] Continuation-in-part of Ser. No. 380,603, July 19, 1973, Pat. No. 3,870,420.

[52] U.S. Cl. ..... 401/121; 15/230.11; 15/257.06

[51] Int. Cl.[2] ..... B44D 3/12

[58] Field of Search ..... 401/121, 123, 131; 15/257.05, 257.06; 312/207

[56] References Cited

UNITED STATES PATENTS

| | | | |
|---|---|---|---|
| 227,117 | 5/1880 | Liebman | 15/257.05 X |
| 2,909,797 | 10/1959 | Whitt | 15/257.06 |
| 3,087,190 | 4/1963 | Werner | 401/121 |
| 3,837,035 | 9/1974 | Habostad | 15/257.06 |

*Primary Examiner*—Lawrence Charles

*Attorney, Agent, or Firm*—Cullen, Settle, Sloman & Cantor

[57] ABSTRACT

A paint tray, for use with a paint roller or the like, including substantially coplanar front and rear edges, a paint well adjacent to and below the rear edge for storing a supply of paint, and an inclined surface tapering upwards from the well to the front edge for rolling excess paint off the roller. The tray and roller coact for supporting at least one portion of the paint roller above the well thereby allowing excess paint from the roller to drip back into the well.

1 Claim, 8 Drawing Figures

PAINT TRAY

CROSS-REFERENCE TO RELATED APPLICATIONS

This is a continuation-in-part of my copending application Ser. No. 380,603, filed July 19, 1973 now U.S. Pat. No. 3,870,420.

BACKGROUND OF THE INVENTION

Conventional paint trays, for use with rollers in applying paint to wall surfaces, are made of cardboard or metal in a roughly rectangular shape. The tray typically has a depression or well near one end into which the painter pours a supply of paint. The well terminates in an inclined surface upon which the painter may roll the paint roller to remove excess paint therefrom.

During periods of non-use of the roller, the painter conventionally places the roller upon the tray with the paint applying portion resting on the inclined surface. All too often, the paint roller flips out of the tray or rolls into the well causing paint to splash out. In the event that neither of these undesirable results occur, storage of the roller on the inclined surface tends to flatten one side of the roller surface which is usually manufactured of a wool-like material or flocking or the like.

Finally, when the time comes to clean and store the paint tray, storage is normally accomplished by merely placing the tray on a shelf or the like. This occupies unnecessary space because of the irregular shape of the tray.

Thus, it is desirable to provide a paint tray which includes an improved mechanism for holding a paint roller during periods of non-use, and a tray which may be conveniently stored after use.

In providing these features for a paint tray, several factors must be appreciated. First, the painter normally has several tools and each additional, independent tool merely adds to the bulk which the painter must carry from job location to job location. Thus, an independent paint roller stand is impracticable. Second, paint trays and the like are typically inexpensive and have a short useful life and it is extremely important that additional features for paint trays be relatively inexpensive.

Third, any feature added to a paint tray must not interfere with the primary function of the tray, namely, a paint reservoir for use with a paint roller in applying paint to a surface.

Hence, the invention herein relates to an improvement in conventional paint trays, namely, means for supporting a roller and for providing for storage of the tray during the periods of non-use.

SUMMARY OF THE INVENTION

The invention herein relates to providing a simple inexpensive support means as part of a paint tray or as part of the roller, which serves to support and hold at least part of the roller above the well of the paint tray during periods of roller non-use. The support means must be extremely inexpensive and must hold the paint roller in such a way that no flattening occurs to the paint applying portion of the roller. In one embodiment, the support means may also be used to store the tray during periods of non-use.

Finally, the improvements to the paint tray of the present invention are extremely inexpensive and do not materially add to the cost of the tray which is a very important factor in this type of competitive disposable device.

BRIEF DESCRIPTION OF DRAWINGS

In the drawings, wherein like reference numerals identify corresponding parts.

DETAILED DESCRIPTION OF THE INVENTION

Figure 1:
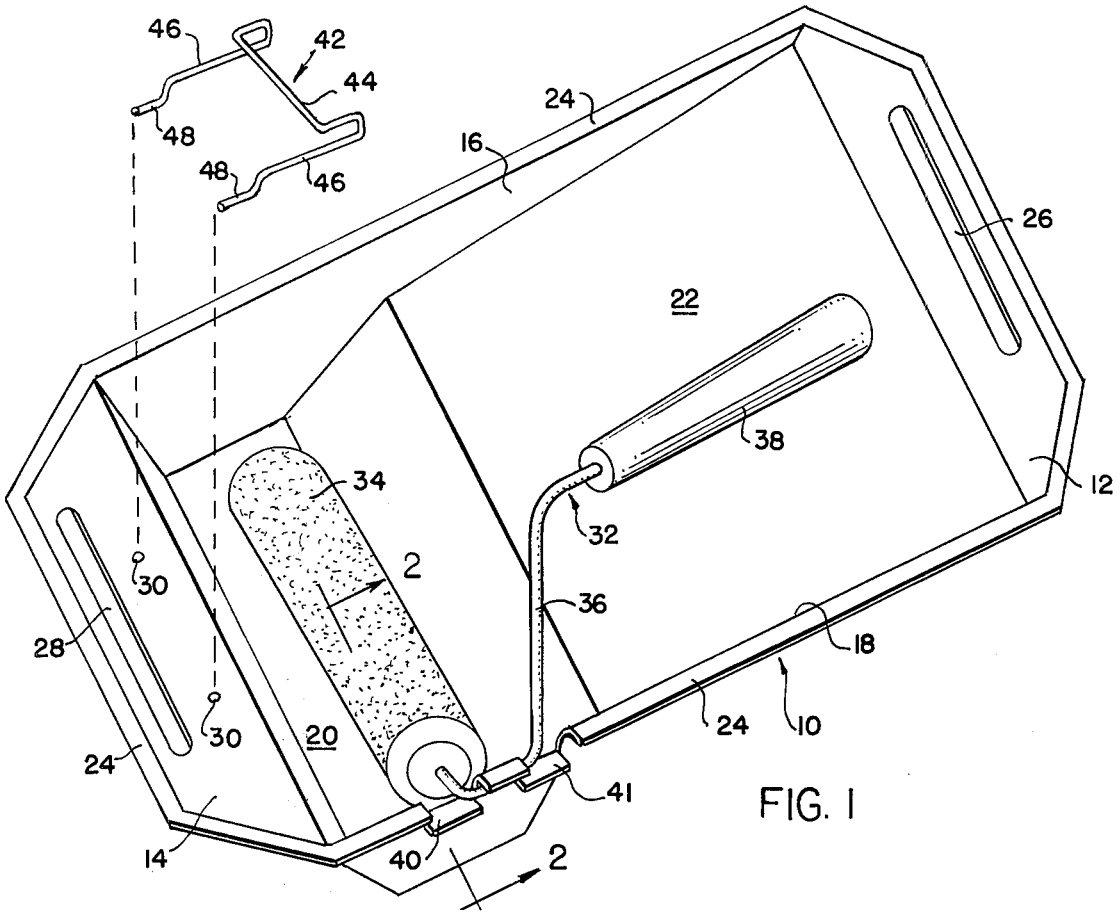
FIG. 1 is a perspective illustration of a paint tray and a paint roller having coacting support means according to the principles of the present invention.
Figure 2:
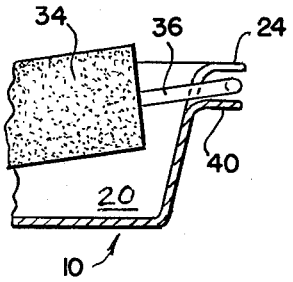
FIG. 2 is a fragmentary end view seen in the direction of arrows 2—2 of FIG. 1.

FIG. 1 illustrates a conventional paint tray 10 having a front edge or surface 12 and a rear edge or surface 14, which are substantially coplanar, and having side walls 16 and 18. The tray includes a well portion 20 positioned adjacent to and below the rear surface 14 for the storage of paint or the like and an integral inclined surface 22 tapering upward from the paint well 20 to the front surface 12.

The paint tray includes a peripheral outwardly extending, lateral flange 24, and optional front and rear hand holds 26 and 28 in the coplanar front and rear surfaces, respectively. The hand holds may be utilized for carrying the tray from one location. to another and is especially beneficial when there is a supply of paint in the well. The rear surface 14 of the tray also includes a plurality of apertures 30.

Illustrated in FIG. 1 is a conventional paint roller 32 having a paint applying portion 34, a bent wire or support rod 36 and a handle 38.

Means are provided for supporting the paint roller on the paint tray. Specifically, a second short flange 40 is provided in the region of the rear surface 14 and the well 20. The second flange 40, which may include multiple sections as at 41, is vertically in a different plane from the main peripheral flange 24.

The vertical spacing between the main flange 24 and the second flange 40 is such that the wire rod 36 may be removably force-fit or frictionally retained therebetween. With the rod so positioned, and with the handle 38 of the roller resting on the inclined surface 22, one end of the paint applying portion 34 of the roller is suspended above the well. The opposite end may tip down into the well and touch the bottom of the well depending upon the degree of freedom and slippage between the flanges and the rod.

With rod 36 force-fit between the flanges, the roller is supported over the well and is secured against splashing into the well or against tipping outward of the tray. The flange arrangement is totally unobtrusive and does not affect use of the paint tray or roller in any fashion.

It should be noted that in the manufacture of a tray having this feature, it is merely necessary to bend down portions of the peripheral flange 24 to form the second flange sections 40 and 41.

Another means for supporting the paint roller is also illustrated in FIG. 1 and includes a wire rod 42 formed into a U-shape and having a wide base 44 and a pair of first legs 46. The first legs are bent into an S-shape and extend from the base of the rod to form a pair of second legs 48.

In operation, the second legs 48 are inserted in the apertures 30 in the rear surface of the paint tray. The second legs are inserted up to the "S" portion, at which time the base 44 of the rod extends over the paint well. The base and the first legs form a support upon which the paint roller may be placed. In this fashion, any paint on the roller will drip down into the well.

Figure 3:
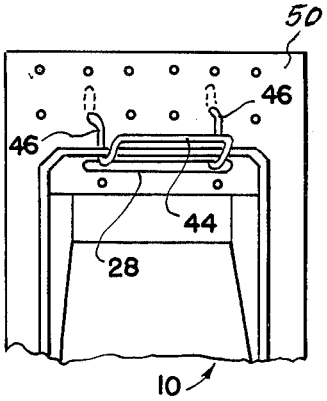
FIG. 3 illustrates the use of a support means for storing the paint tray.

When it is desired to store the paint tray after use, the wire rod 42 is removed from the apertures 30 and inserted into apertures in a conventional pegboard 50 as seen in FIG. 3. The hand hold 28 is slipped over the base 44 of the wire rod and the paint tray may be suspended in a vertical fashion to occupy a minimum of storage space.

EMBODIMENTS OF FIGS. 4–8

Figure 4:
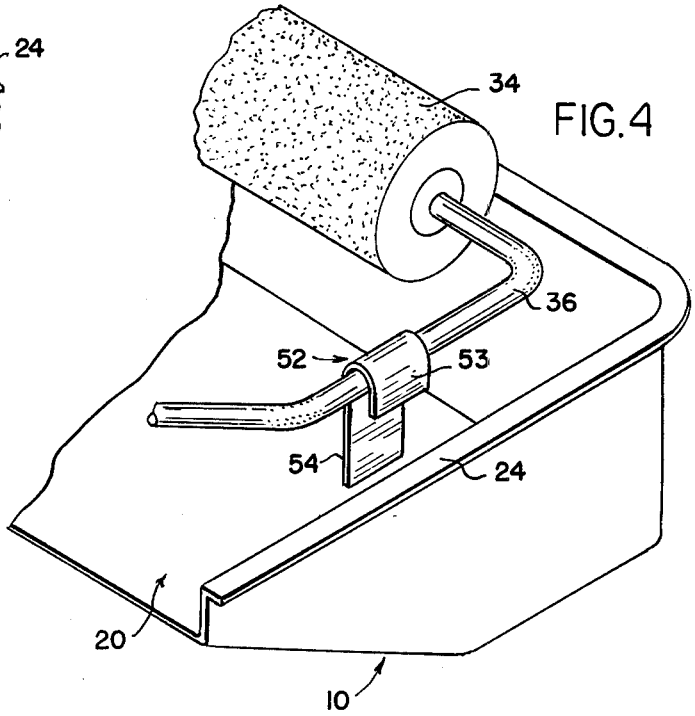
FIG. 4 illustrates another embodiment of a support means.

FIG. 4 illustrates an embodiment of a support means including a clip 52 for securing the roller and tray together. The clip 52 is of a generally U-shaped configuration having first and second legs 53, 54. The clip is attached to the bent portion of the wire rod 36, either by welding or by a force-fit, with the legs extending downwardly perpendicular to the rod. The spacing between the legs is such that the clip may be releasably force-fit onto the flange 24. Thus the roller 32 is supported by the tray 10 with the paint applying portion over the paint well 20.

Figure 5:
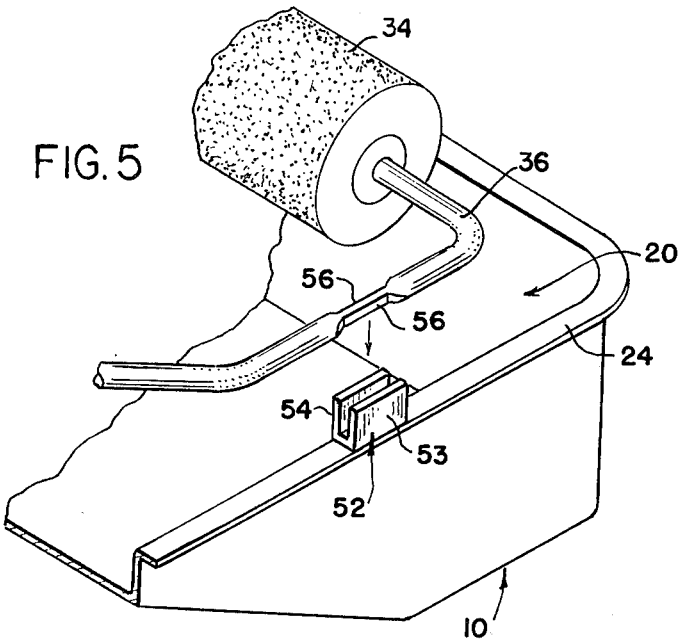
FIG. 5 illustrates another embodiment of a support means for holding the paint roller over the well of the paint tray.

In the embodiment of FIG. 5, the clip 52 having legs 53 and 54 is welded to the flange 24 with the legs extending upwardly in a channel-like configuraton. The wire rod 36 is provided with recesses or flats 56 of a size to fit between the legs of the clip. When it is desired to support the roller over the paint well, the wire rod 36 and specifically the recessed portions 56 are releasably force-fit into the clip 52.

Figure 6:
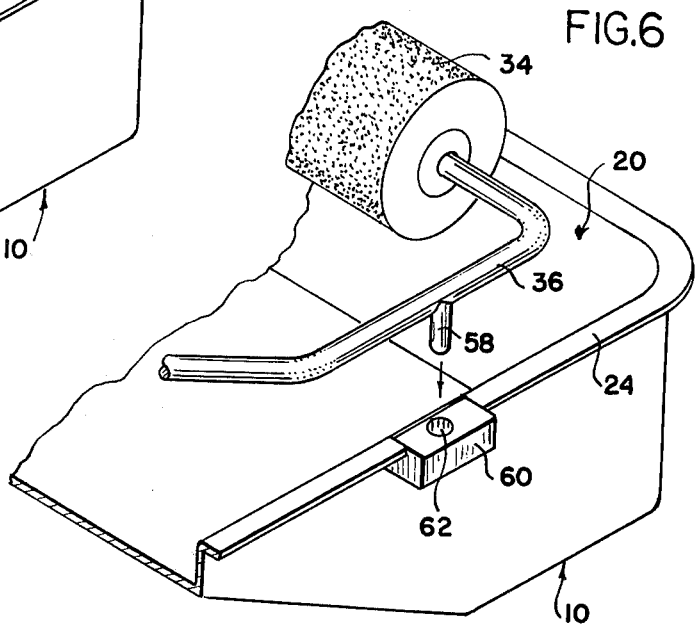
FIG. 6 illustrates another embodiment of the present invention.
Figure 7:
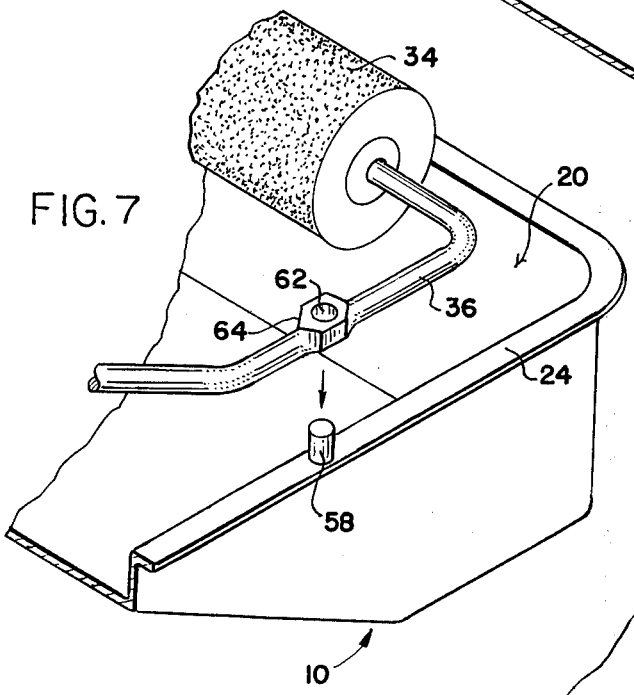
FIG. 7 is yet another embodiment of the present invention.

The embodiments of FIGS. 6 and 7 rely on the coaction of a post or stud and an aperture for supporting the roller above the paint well.

In FIG. 6 the wire rod 36 includes a downwardly projecting post or stud 58. Extending laterally outwardly from flange 24 is an auxilliary flange 60 having a suitable aperture 62 of a size and shape to receive the post 58. When the post is inserted in the aperture, the paint applying portion is supported above the paint well.

In FIG. 7 the flange 24 includes an upwardly extending post or stud 58. The wire rod 36 includes an aperture 62 therethrough to receive the post. If necessary, a portion of the rod may be of enlarged diameter, as at 64, to accommodate the aperture 62 without the resultant loss of strength in the rod.

Figure 8:
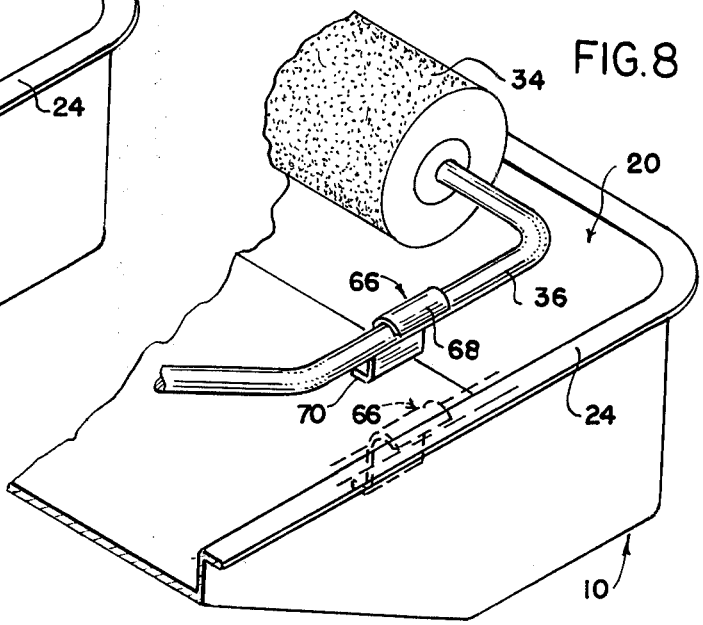
FIG. 8 is still another embodiment of the present invention.

Finally, in FIG. 8, a clip 66 is provided having a generally S-shaped configuration. One leg is welded to the rod 36, as at 68. The other leg 70 is removably hooked under the flange 24 of the tray when it is desired to support the roller over the paint well. As illustrated, clip 66 is oriented to be hooked under flange 24 by moving the roller toward the tray from the exterior thereof.

The foregoing is a description of operative embodiments of the present invention and should not be read in a limiting sense but only as describing the underlying inventive concepts. The invention may be further developed within the scope of the following claims.

What is claimed is:

1. In a paint tray for use with a paint roller or the like, said paint roller having a bent wire rod supporting a paint applying portion at one end and having a handle at the other end, said paint tray including substantially coplaner front and rear edges, a paint well adjacent to and extending vertically below said rear edge for storing a supply of paint, and an integral inclined surface tapering upwardly from said paint well to said front edge for rolling excess paint off said paint applying portion whereby execes paint flows into said well, said paint tray further including a peripheral outwardly extending lateral flange substantially coplaner with said front and rear edges, the improvement comprising:

a small relatively thin support member defining a slot for retaining said bent wire rod and said flange together for supporting the paint applying roller above the paint well, said support member being formed by said paint tray flange having at least one portion thereof bent to form a second flange, said flange and said second flange defining said slot therebetween for frictionally retaining said bent wire rod therein.

* * * * *